US008302531B2

(12) United States Patent
Kamiyama et al.

(10) Patent No.: US 8,302,531 B2
(45) Date of Patent: Nov. 6, 2012

(54) SELF-INKING STAMP

(75) Inventors: Takeyuki Kamiyama, Ichinomiya (JP); Motokazu Ito, Nagoya (JP)

(73) Assignee: Shachihata Inc., Aichi (JP)

( * ) Notice: Subject to any disclaimer, the term of this patent is extended or adjusted under 35 U.S.C. 154(b) by 417 days.

(21) Appl. No.: 12/659,360

(22) Filed: Mar. 5, 2010

(65) Prior Publication Data

US 2010/0326299 A1 Dec. 30, 2010

(30) Foreign Application Priority Data

Jun. 24, 2009 (JP) ..... 2009-149516
Dec. 25, 2009 (JP) ..... 2009-295767

(51) Int. Cl.
*B41K 1/40* (2006.01)

(52) U.S. Cl. ..... 101/334; 101/333; 101/104; 101/405

(58) Field of Classification Search ..... 101/327, 101/333, 334, 405, 406, 103, 104; *B41K 1/40*
See application file for complete search history.

(56) References Cited

U.S. PATENT DOCUMENTS

| | | | | |
|---|---|---|---|---|
| 2,312,727 | A | 3/1943 | Nisenson | |
| 2,939,390 | A | 6/1960 | Clausing | |
| 3,779,164 | A | 12/1973 | Study | |
| 4,432,281 | A | 2/1984 | Wall et al. | |
| 4,603,628 | A | 8/1986 | Just | |
| 5,152,223 | A | 10/1992 | Mairon | |
| 5,727,467 | A | 3/1998 | Skopek | |
| 5,850,787 | A | 12/1998 | Pichler | |
| 7,069,852 | B2 | 7/2006 | Zindl et al. | |
| 2003/0150343 | A1 | 8/2003 | Koneczny | |
| 2004/0055486 | A1* | 3/2004 | Treml | 101/333 |
| 2005/0145127 | A1 | 7/2005 | Zindl et al. | |
| 2006/0162596 | A1 | 7/2006 | Faber | |
| 2007/0012206 | A1 | 1/2007 | Pointl | |

FOREIGN PATENT DOCUMENTS

JP 54-134520 U 9/1979

* cited by examiner

*Primary Examiner* — Leslie J Evanisko
(74) *Attorney, Agent, or Firm* — Jacobson Holman PLLC

(57) ABSTRACT

One object of the present invention is to provide a self-inking stamp which can easily perform replacement of a character arrangement block or an ink pad without sudden release of locked condition of the stamp during the replacement operation. According to the present invention there is provided a self-inking stamp comprising an inner frame member (10) provided therein with a reversing guide (14), an outer frame member (20) slidably mounted on the inner frame member (10) via an elastic member or members (30) therebetween, a main body (50) of stamp containing the character arrangement block (51) and adapted to be reversed by the reversing guide (14), and an ink pad (42) adapted to be arranged within the inner frame member (10) characterized in that the inner frame member (10) is formed on its side wall with a projection (16) movable toward the inside of the inner frame member (10), that the outer frame member (20) is formed on its side wall a pusher (26) for pushing the projection (16) toward the inside of the inner frame member (10) and an engaging portion (27) adapted to be engaged with the projection (16), and that a vertical relative motion between the inner and outer members (10, 20) is locked when the projection (16) is fitted in the engaging portion (27) and the lock is released when the pusher (26) is pushed inside to disengaging the projection (16) from the engaging portion (27).

7 Claims, 11 Drawing Sheets

SELF-INKING STAMP

FIELD OF THE INVENTION

The present invention relates to a reversible stamp, or a self-inking stamp in which a character arrangement block contained in a main body of stamp is usually faced upward by an elastic members being contacted with a ink pad, and on the other hand, the character arrangement block is reversed by a reversing guide to a stamping position when the self-inking stamp is pushed against a force of the elastic member.

DESCRIPTION OF BACKGROUND ART

Heretofore there has been many patent applications relating to the self-inking stamp of this kind, e.g. those in which the stamp is formed of fixed characters, or of a rotary stamp using an endless rotary character belt. In such a self-inking stamp, the character arrangement block and the ink pad which are always contacted with each other must be kept in a separated condition when performing replacement of the character arrangement block, change of characters by rotating the endless rotary character belt, replacement of the ink pad or replenishment of ink. However it is difficult to perform these operations since it is impossible to keep a separated condition between the character arrangement block and the ink pad in such a self-inking stamp.

Improvements of these problems in the self-inking stamp have been disclosed in Japanese Laid-open Utility model Publication No. 54-134520 (1979) and U.S. Pats. Nos. 5,152,223, 5,727,467 and 5,850,787. In a self-inking stamp of this type, the character arrangement block and the ink pad are always contacted with each other by coil springs and the stamping of characters can be performed simultaneously with 180° reversing of the main body of stamp containing the character arrangement block and the locked condition can be obtained when the main body of stamp is reversed by 180°.

Japanese Laid-open Utility model Publication No. 54-134520 (1979) and U.S. Pat. No. 5,152,223 disclose a self-inking stamp in which the locked condition can be achieved by inserting a stopper member into an opening formed by alignment of an opening formed on an outer frame member and an opening formed on an underlying part when the outer frame member is pressed downward against a force of the elastic member and the main body of stamp is reversed by 180°.

U.S. Pat. No. 5,727,467 discloses a self-inking stamp which is locked by engaging a tongue portion formed on an outer frame member with a recess formed on an inner frame member when the outer frame member is pushed downward against an elastic member.

U.S. Pats. Nos. 5,850,787 and 7,069,852 disclose a self-inking stamp which is locked by engaging an engaging push button formed on an outer frame member with a notch formed on an inner frame member when the outer frame member is pushed downward against an elastic member.

As described above the self-inking stamps of this kind are those structured so that operations such as replacement of the character arrangement block, change of the character arrangement block by rotating the endless rotary character belt, replacement of the ink pad and replenishment of ink can be performed in the locked condition by reversing the main body of stamp by 180°.

DOCUMENTS OF PRIOR ART

Patent Documents

Patent Document 1: Japanese Laid-open Utility Model Publication No. 54-134520 (1979)

Patent Document 2: U.S. Pat. No. 5,152,223
Patent Document 3: U.S. Pat. No. 5,727,467
Patent Document 4: U.S. Pat. No. 5,850,787
Patent Document 5: U.S. Pat. No. 7,069,852

SUMMARY OF THE INVENTION

Problems to be solved by the Invention

However there are problems in the self-inking stamps of the prior art in the locking operation. For example in the self-inking stamps of Japanese Laid-open Utility Model Publication No. 54-134520 (1979) and U.S. Pat. No. 5,152,223, it is difficult to perform the locking operation by one hand since a user must insert the stopper member by one hand with keeping the main body of stamp at a 180° reversed condition by pushing the outer frame member against the elastic member by another hand. In addition similarly to the locking operation, release of the lock must be performed by pulling out the stopper member by one hand with pushing the outer frame member by another hand.

In the self-inking stamp disclosed in U.S. Pat. No. 5,727,467, it is necessary for achieving its locked condition to align the tongue portion formed on the outer frame member with the recess formed on the inner frame member with allowing for a pushing force applied to the outer frame member against the elastic member and thus it is required complicated operations to insert the tongue portion into the recess after having aligned the positions of them. In addition it is possible that the lock would be suddenly released during replacement of the character arrangement block since the locking mechanism tends to be released by a slight pushing force.

In the self-inking stamps disclosed in U.S. Pats. Nos. 5,850,787 and 7,069,852, it is necessary for achieving their locked conditions to align the engaging push button formed on the outer frame member with the notch formed on the inner frame member with allowing for a pushing force applied to the outer frame member against the elastic member and thus it is required complicated operations to insert the push button into the notch after having aligned the positions of them. In addition it is possible that the lock would be suddenly released during replacement of the character arrangement block since the locking mechanism tends to be released by a slight pushing force.

Furthermore it is required a cumbersome operation to pull out the ink pad from the stamp during performing the replacing operation of the ink pad since no pinching portion is formed on the ink pad in the self-inking stamps disclosed in Japanese Laid-open Utility Model Publication No. 54-134520 (1979) and U.S. Pats. Nos. 5,152,223 and 5,727,467. On the contrary the ink pad of the self-inking stamp disclosed in U.S. Pat. No. 5,850,787 is formed with a pinching portion. However this stamp requires a knob for achieving an easy stamping operation. When the knob is not used, it is necessary to directly grip the outer frame member and thus the pinching portion of the ink pad would disturb the stamping operation. In order to overcome this problem the self-inking stamp disclosed in U.S. Pat. No. 7,069,852 is provided with a foldable pinching portion of the ink pad. However the foldable pinching portion is weak in strength and would be broken after repeat use of the pinching portion.

An additional fault of the self-inking stamp is that volatile ink impregnated in the ink pad tends to be evaporated during it is not used.

Means for solving the Problems

In order to overcome the problems described above of the prior art, there is provided, according to the present invention, a self-inking stamp comprising:

an inner frame member provided therein with a reversing guide, an outer frame member slidably mounted on the inner frame member via an elastic member or members therebetween, a main body of stamp containing the character arrangement block and adapted to be reversed by the reversing guide, and an ink pad adapted to be arranged within the inner frame member characterized in:

that the inner frame member is formed on its side wall with a projection movable toward the inside of the inner frame member, that the outer frame member is formed on its side wall a pusher for pushing the projection toward the inside of the inner frame member and an engaging portion adapted to be engaged with the projection, and that a vertical relative motion between the inner and outer members is locked when the projection is fitted in the engaging portion and the lock is released when the pusher is pushed inside to disengaging the projection from the engaging portion.

It is preferable that the ink pad can be contained within an ink cartridge, that a port formed on one side wall of the inner frame member for taking in and out the ink cartridge to and from the inner frame member, and that a port formed on one side wall of the outer frame member for taking in and out the ink cartridge to and from the inner frame member.

It is preferable that the ink cartridge is formed on its one side face with a pinching portion, and that the outer frame member is formed with a groove continuous with the port in which the pinching portion can slide therealong.

It is also preferable that each of the inner and outer frame members is a box of a rectangular parallelepiped of which bottom is opened, and that the projection is formed on a wider side wall of the inner frame member, and the pusher and the engaging portion are formed on a wider side wall of the outer frame member.

It is preferable that each of the inner and outer frame members is a box of a rectangular parallelepiped of which bottom is opened, and that the projection is formed on a narrower side wall of the inner frame member, and the pusher and the engaging portion are formed on a narrower side wall of the outer frame member.

It is preferable that the main body of stamp detachably contains character arrangement block holder for holding the character arrangement block.

It is also preferable that a holding portion for holding a member to be stamped is formed on the bottom end of the inner frame member.

It is also preferable that either one of peripheral edges of a portion for holding the character arrangement block or of a portion for containing the ink pad is provided with a packing, and the other of the peripheral edges is provided with an abutting portion against which the packing abuts, and that the packing is adapted to be closely abutted against the abutting portion when the ink pad is contacted by the character arrangement block.

EFFECTS OF THE INVENTION

According to the present invention following effects can be obtained.

The locked condition of the self-inking stamp can be easily achieved by simply engaging the projection formed on the side wall of the inner frame member and deformable inside thereof with the engaging portion formed on the side wall of the outer frame member by simply pushing the outer frame member against the force of the elastic member.

The locked condition can be easily released by simply pressing the pusher to move the projection toward inside of the inner frame member and to disengage the projection from the engaging portion formed on the outer frame member. Accordingly the sudden release of locking of the stamp e.g. during replacement of the character arrangement block can be surely prevented.

In addition according to the self-inking stamp of the present invention, taking-in or taking-out operation of the ink cartridge into or from the main body of stamp can be easily achieved by the provision of the picking portion on the ink cartridge. Simultaneously according to the present invention, it is possible to prevent a user's palm from being contacted with the pinching portion of the ink cartridge when a user performs the printing operation with gripping the outer frame member.

Furthermore evaporation or drying of ink impregnated in the ink pad can be effectively prevented by provision of the packing between the main body of stamp and the ink cartridge which sealingly close them when the ink pad and the character arrangement block contact each other.

BEST MODE FOR CARRYING OUT THE INVENTION

Figure 1:
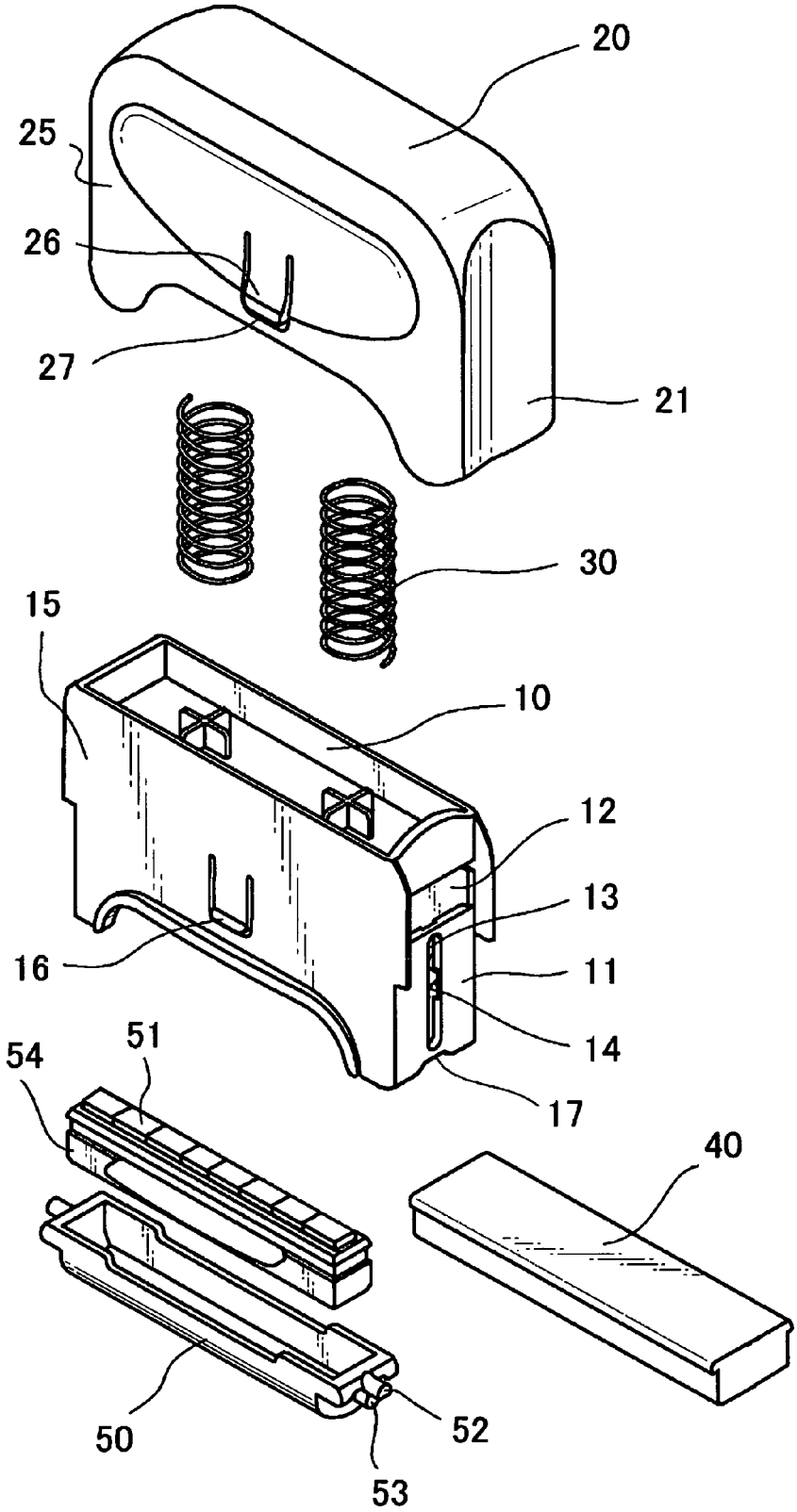
FIG. 1 An exploded perspective view taken from the top of a first embodiment of the self-inking stamp of the present invention.
Figure 2:
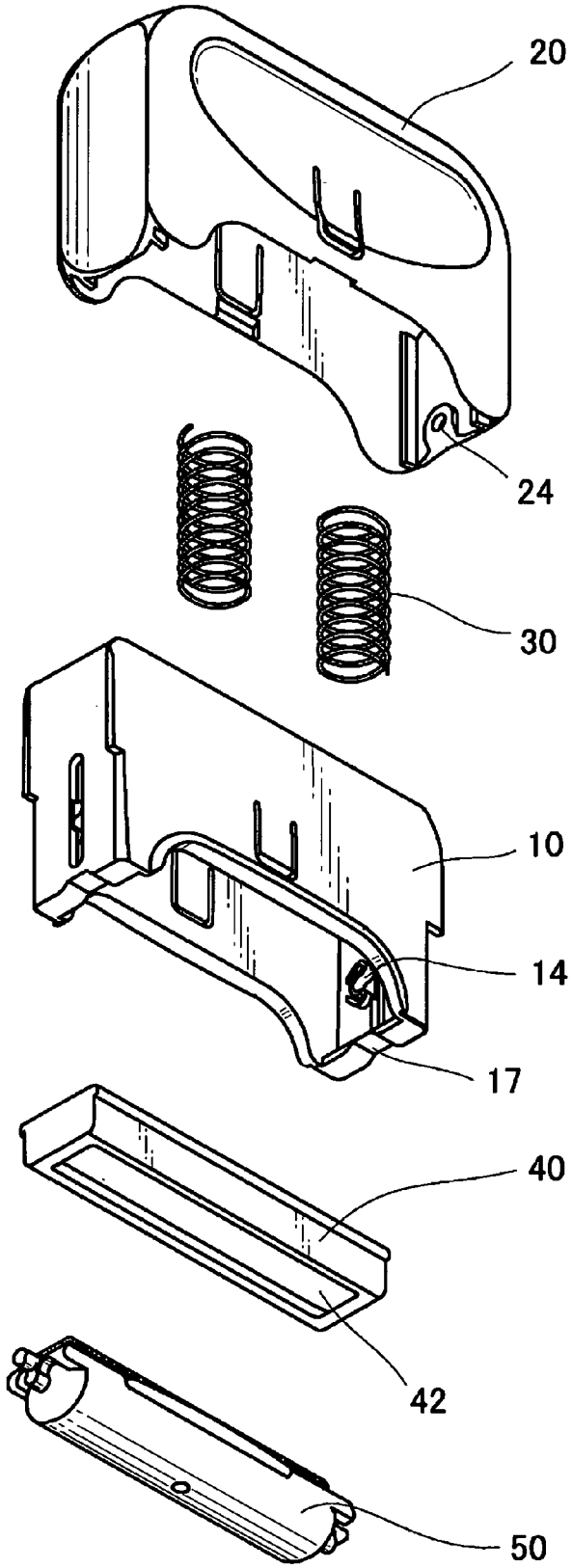
FIG. 2 An exploded perspective view taken from the bottom of a first embodiment of the self-inking stamp of the present invention.

A first embodiment of the present invention will be hereinafter described with reference to FIGS. 1 through 5.

A reference numeral 10 denotes an inner frame member of box-like configuration having an opened bottom and adapted to contain therein an ink cartridge 40. The inner frame member 10 may be a rectangular parallelepiped or a cube having a box-like configuration and an opened bottom. The term "rectangular parallelepiped" is defined herein as a solid surrounded by six rectangles all adjacent ones of which crossing at 90° each other, and the term "cube" is defined herein as a solid surrounded by six congruent squares.

When the inner frame member 10 is a box-like rectangular parallelepiped having an opened bottom, slits 13 in which central shafts 52 formed on both ends of a main body of stamp 50 can slide are formed on narrower side walls 11 of the inner frame member 10 below a port for taking-in or taking-out the ink cartridge 40 to or from the inner frame member 10. Reversing guides 14 are formed on the inner surfaces of the narrower side walls 11. The illustrated reversing guides 14 are integrally formed on the inner surfaces of the narrower side walls 11 of the inner frame member 10 as disclosed in U.S. Pat. Nos. 2,312,727, 3,779,164 and 4,432,281. However it is possible to use reversing guides of a curved groove type as disclosed in U.S. Pat. Nos. 2,939,390 and 4,603,628 and a reversing guide using a cam plate as disclosed in U.S. Pat. No. 4,432,281. A projection 16 is formed on a wider side wall 15 of the inner frame member 10. The projection 16 is formed so that its one end is integrally connected to the wider side wall 15 and a remained circumference is separated from the wider side wall 15 via a slit. Thus the projection 16 is connected to the wider side wall 15 of the inner frame member 10 so that it can elastically bend relative to the wider side wall 15. Although it is illustrated that the projection 16 is formed on both wider side walls 15, it is possible to form only one projection 16 on one wider side wall 15. When using a cube as the inner frame member 10, it is advantageous that the slits 13, reversing guide 14 and projections 16 can be formed on any side wall without consideration whether it is wider or narrower side wall.

A reference numeral 20 denotes an outer frame member of box-like configuration having an opened bottom. The outer frame member 20 may be a rectangular parallelepiped or a cube.

When the outer frame member 20 is a rectangular parallelepiped having an opened bottom, secured apertures 24 to which the central shafts 52 are inserted are formed on inner surfaces of the narrower side walls 21 at a low position thereof. A pusher 26 is formed on a wider side wall 25 of the outer frame member 20. The pusher 26 is formed so that its one end is integrally connected to the wider side wall 25 and a remained circumference is separated from the wider side wall 25 via a slit. The bottom of the slit forms an engaging portion 27 into which the projection 16 is fitted. Although it is illustrated that the pusher 26 and the engaging portion 27 are formed on both wider side walls 25, it is possible to form one pusher 26 and engaging portion 27 on one wider side wall 25. When using a cube as the outer frame member 20, it is advantageous that the secured apertures 24 and the pusher 26 can be formed on any side wall without consideration whether it is wider or narrower side wall.

A reference numeral 30 denotes an elastic member arranged between the inner and outer frame members 10 and 20 to hold the outer frame member 20 vertically movable relative to the inner frame member 10. Although the elastic member 30 comprises two coil springs in the illustrated embodiment, it is not limited to the coil spring and can use other types of springs.

A reference numeral 40 denotes an ink cartridge for containing an ink pad 42. The ink pad 42 comprises a porous member of sponge, felt etc. in which ink is impregnated.

A reference numeral 50 denotes a main body of stamp in which a holder 54 for holding a character arrangement block 51 is fitted. The character arrangement block 51 has character arrangements on its top and bottom sides. The character arrangement block 51 is not a so-called permeable stamp of porous material and is a stamp of a type for transferring thereon ink of the ink pad 42 and includes large and small size groups of characters mounted on the top and bottom sides of the holder 54. The character arrangement block holder 54 is detachably mounted on the main body of stamp 50 and can be replaced between several kinds of large and small size characters according to its applications. The main body of stamp 50 may be a plurality of endless character belts in stead of the character arrangement block 51. Each lateral opposite end of the main body of stamp 50 is provided with a central shaft 52 fitted in the secured aperture 24 of the outer frame member 20 and with a reversing shaft 53 cooperating with the reversing guide 14 to stably rotate the main body of stamp 50.

The self-inking stamp of the present invention can be assembled firstly by mounting the central shaft 52 of the main body of stamp 50 in the slit 13 of the inner frame member 10 so that it can freely slide in the slit 13, then mounting the ink cartridge 40 into the inner frame member 10 through the port 12, then arranging the elastic member 30 on the top surface of the inner frame member 10, and finally fitting the central shaft 52 in the secured aperture 24 of the outer frame member 20 during mounting the outer frame member 20 on the inner frame member 10 with keeping the elastic member 30 on the top of the inner frame member 10.

The operation of the self-inking stamp of the first embodiment of the present invention will be hereinafter described.

Figure 3:
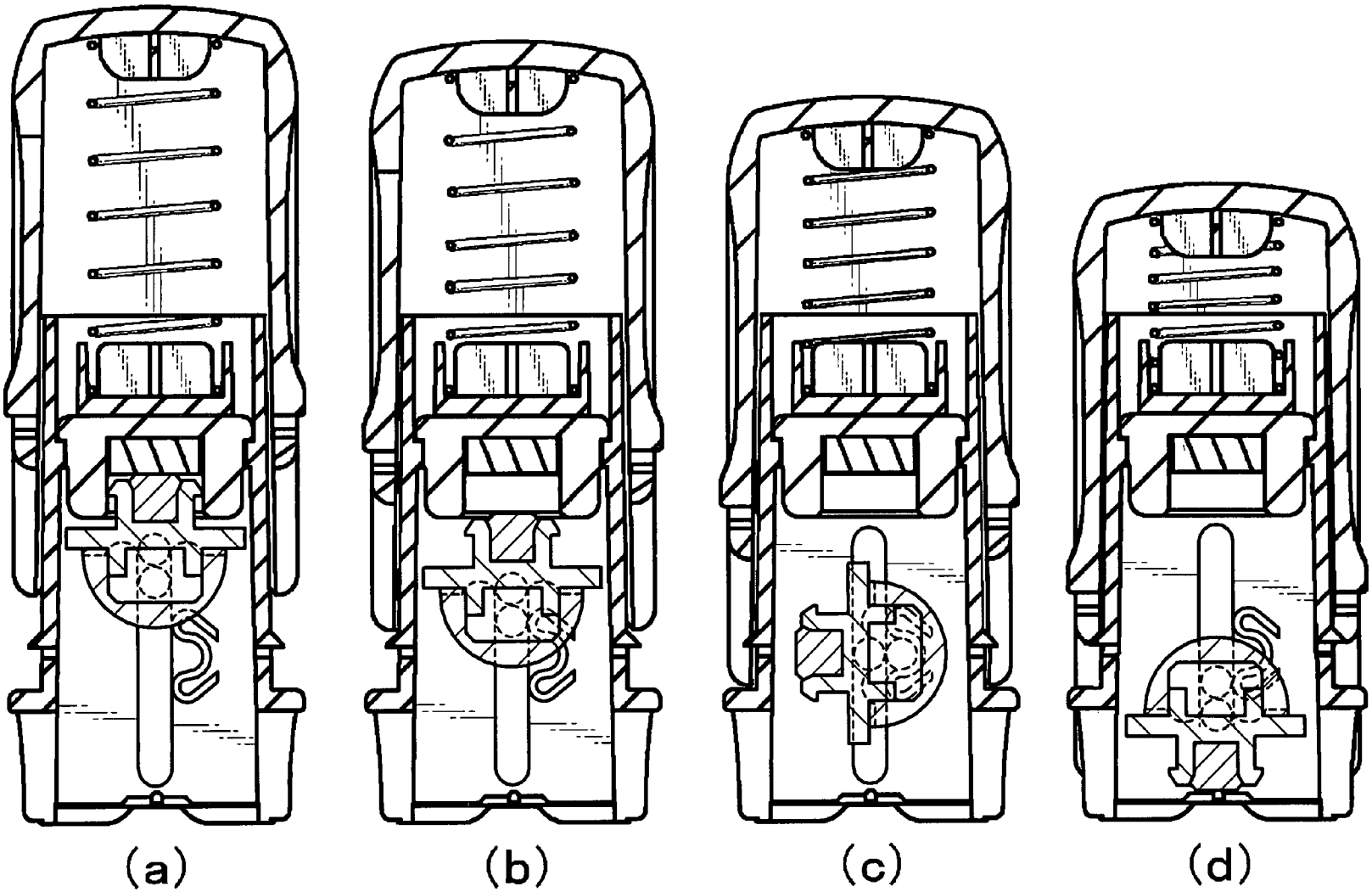
FIG. 3 Explanatory views of operation of the self-inking stamp of the first embodiment of the present invention (FIGS. 3(*a*) through 3(*d*)).

The self-inking stamp is usually placed on a paper so that the bottom end of the inner frame member 10 contacts with the paper and has a condition in which the elastic member is in a most extended condition, the inner and outer frame members 10 and 20 are in a most separated condition, and the character arrangement block 51 is in an upwardly faced condition with being contacted with the ink pad 42 (see FIG. 3(*a*)).

Then a user grips the outer frame member 20 and push it downward relative to the inner frame member 10 against the elastic member 30. During which the central shaft 52 of the main body of stamp 50 fitted in the secured aperture 24 is also moved downward in the slit 13 therealong (see FIG. 3(*b*)).

Then the outer frame member 20 is further moved downward. The main body of stamp 50 is contacted with the reversing guide 14, rotated by 90° around the central shaft 52 and occupies a laterally faced position. During which the reversing shaft 53 is fitted in a groove formed in the center of the reversing guide 14 and thus the main body of stamp 50 can be stably rotated without any rattle (see FIG. 3(*c*)).

Then the outer frame member 20 is further moved downward. The main body of stamp 50 is reversed completely by 180° to occupy a downwardly faced position by cooperative action between the reversing guide 14 and the reversing shaft 53 and thus the character arrangement block 51 can be pressed against the paper laid under the self-inking stamp to stamp thereon the character arrangement. It should be noted that the self-inking stamp is not locked in this position since the bottom end of the inner frame member 10 contacts against the paper surface and thus the projection 16 formed on the inner frame member 10 cannot reach the engaging portion 27 formed on the outer frame member 20 (see FIG. 3(*d*)).

Finally a user releases the downwardly pushing force applied to the self-inking stamp. Accordingly the self-inking stamp can be returned to its initial position by the spring back action of the elastic member 30 reversely through all the steps described above and the character arrangement block 51 can be contacted with the ink pad 42 to have ink application therefrom.

According to the self-inking stamp of the present invention it is possible to replace the character arrangement block 51 (or its holder 54) or the ink cartridge 40 with another one or new one. For making the replacing operation easy, it is desired to hold the inner frame member 10 and the outer frame member 20 in the locked condition at a position in which the character arrangement block 51 (or its holder 54) or the ink cartridge 40 can be replaced.

Figure 4:
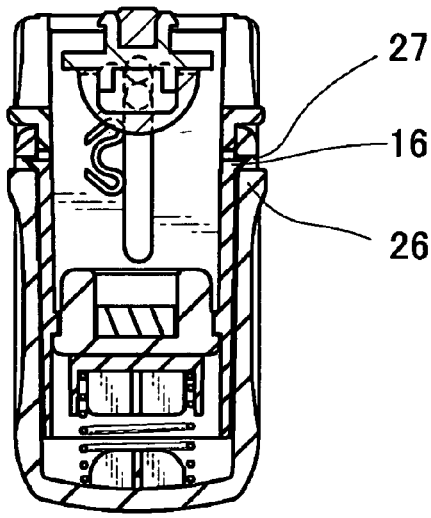
FIG. 4 Explanatory view of locking operation of the self-inking stamp of the first embodiment of the present invention.
Figure 5:
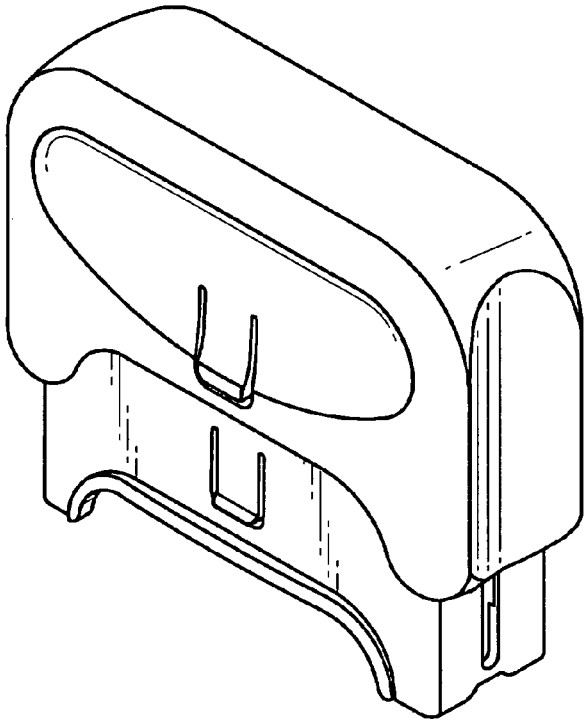
FIG. 5 A perspective view showing the whole of the self-inking stamp of the first embodiment of the present invention.

For performing the replacing operation of the character arrangement block 51 (or its holder 54) or the ink cartridge 40, a user pushes the inner frame member 10 downward by his (or her) fingers after the opened bottom of the inner frame member 10 of the reversing stamp has been directed upward as shown in FIG. 4. Thus the inner frame member 10 is moved downward with the elastic member 30 being compressed and the central shaft 52 fitted in the secured aperture 24 of the outer frame member 20 is moved upward in the slit 13 therealong. When the inner frame member 10 is further moved downward, the main body of stamp 50 is contacted with the reversing guide 14, rotated by 90° around the central shaft 52 and occupies a laterally faced position. When the inner frame member 20 is further moved downward, the main body of stamp 50 is reversed completely by 180° to occupy a upwardly faced position by cooperative action between the reversing guide 14 and the reversing shaft 53. If the inner frame member 10 is further moved downward, the projection 16 elastically supported on the inner frame member 10 is once contacted with the outer frame member 20 and then rides over the outer frame member 20 with being deflected toward inside of the outer frame member 20 due to its elasticity. When the inner frame member 10 is further moved downward, the projection 16 of the inner frame member 10 is fitted in the engaging portion 27 formed by a cutting in the outer frame member 20 and thus the inner and outer frame members 10 and 20 are locked each other.

Under such a locked condition of the self-inking stamp, the main body of stamp 50 is elevated and thus the character arrangement block 51 is exposed to outside of the self-inking stamp. Thus it is possible to easily replace the character arrangement block 51 (or its holder 54) or the ink cartridge 40 with another one or new one.

For releasing the locked condition, a user pushes the pusher 26 of the outer frame member 20 inside. Thus the projection 16 now positioned oppositely to the pusher 26 can be moved inside and accordingly engagement between the projection 16 and the engaging portion 27 is released. Simultaneously with this operation, the self-inking stamp can be returned to its initial position by the elastic member reversely through all steps described above.

Figure 6:
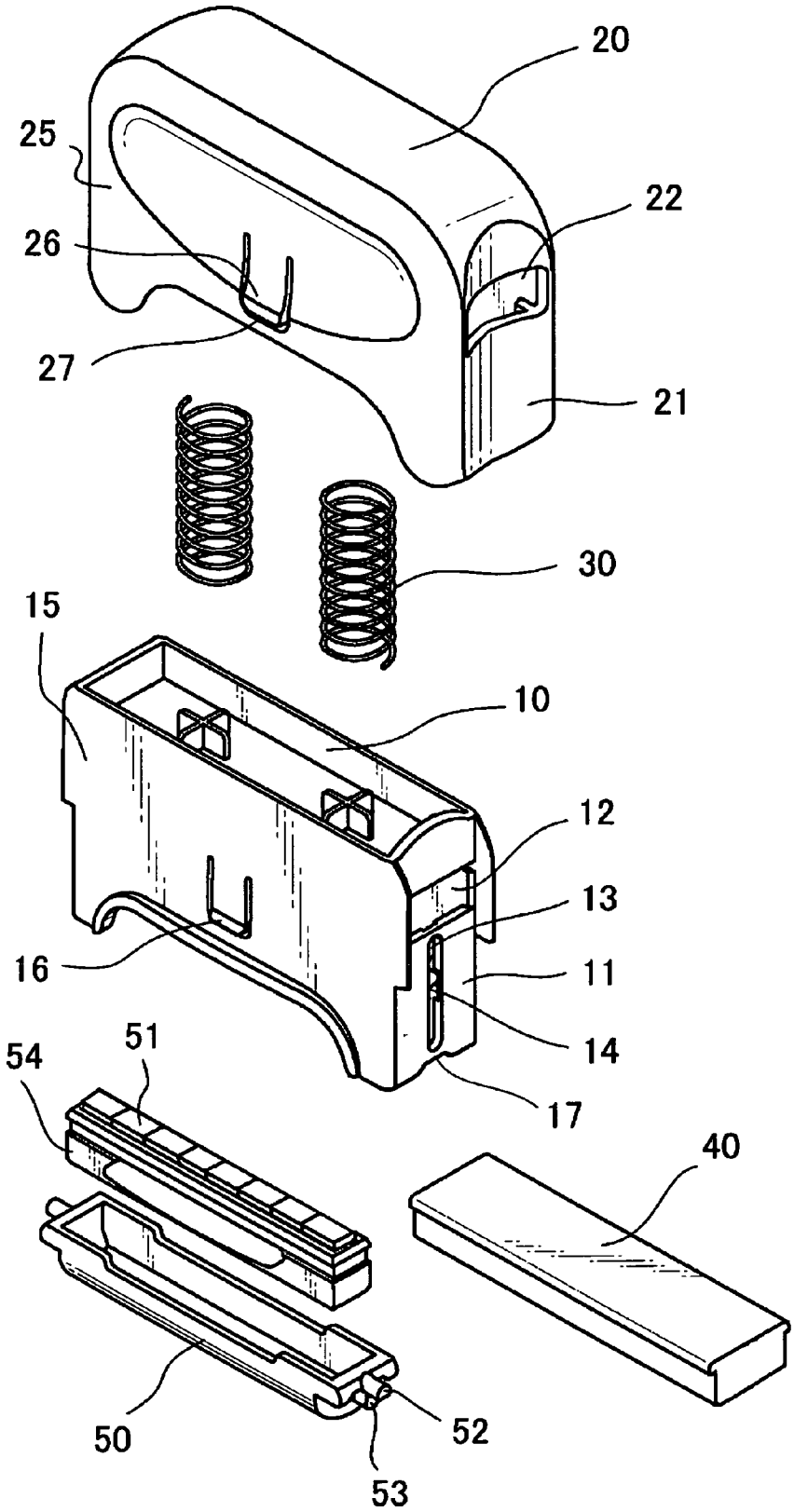
FIG. 6 An exploded perspective view taken from the top of a second embodiment of the self-inking stamp of the present invention.
Figure 7:
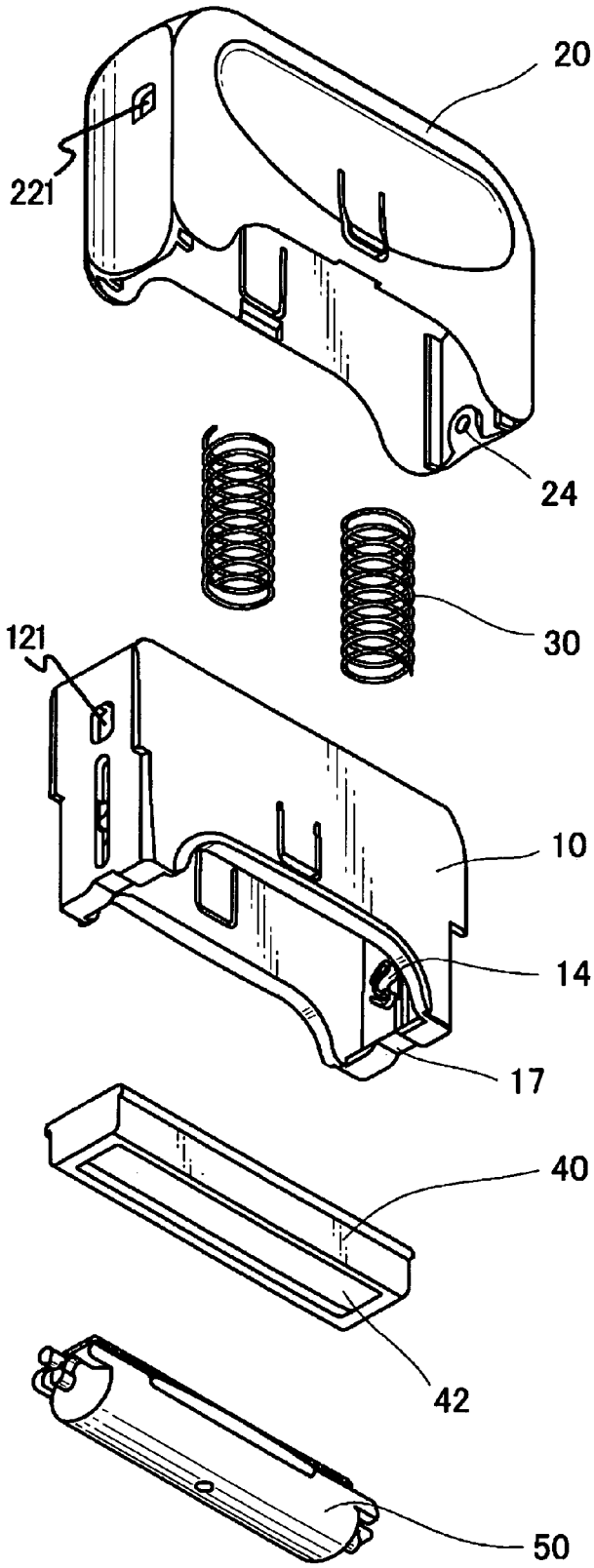
FIG. 7 An exploded perspective view taken from the bottom of a second embodiment of the self-inking stamp of the present invention.
Figure 8:
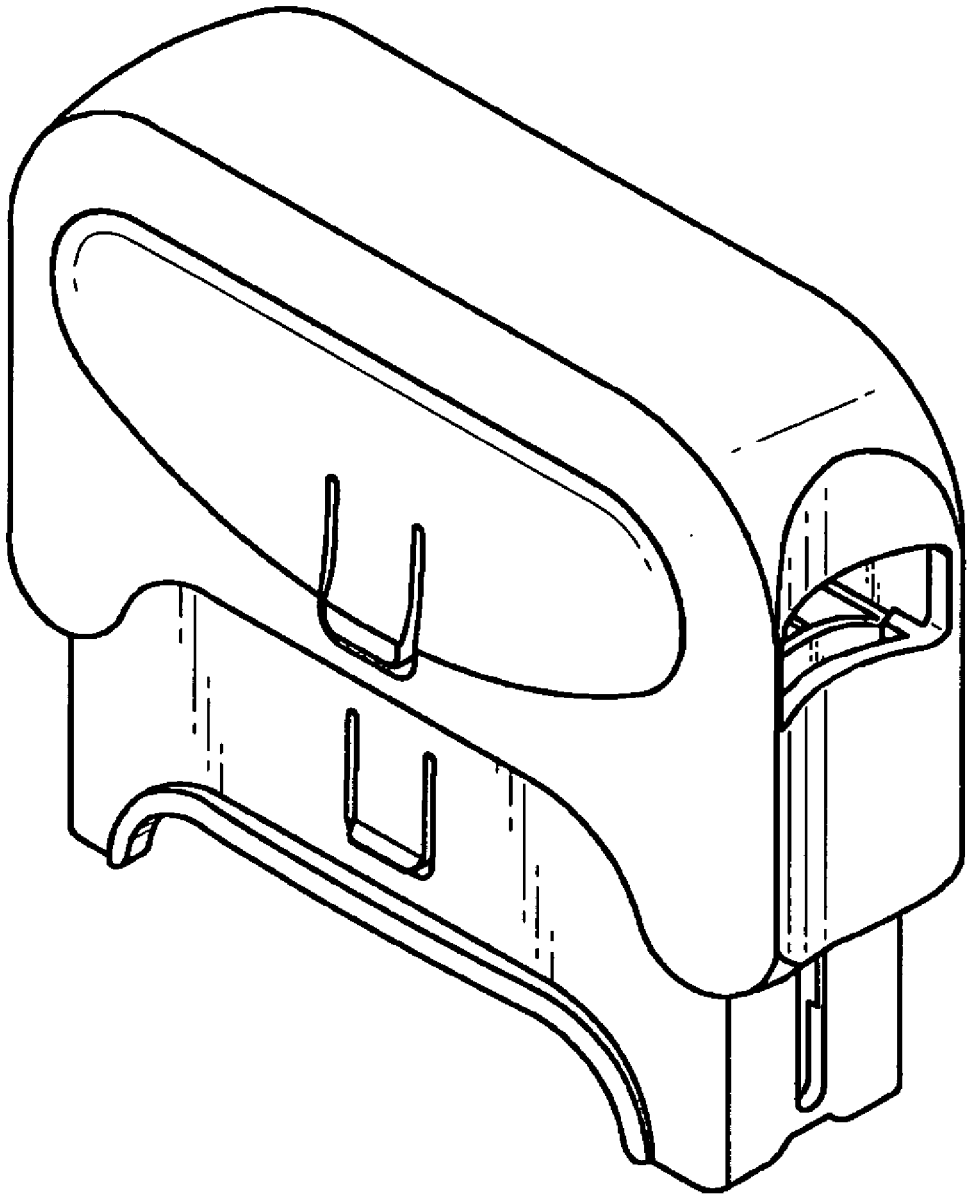
FIG. 8 A perspective view showing the whole of the self-inking stamp of the second embodiment of the present invention.

Then a second embodiment of the self-inking stamp of the present invention will be described with reference to FIGS. 6 through 8. Only features different from the first embodiment will be herein described.

Ports 12 are formed on narrower side walls 11 of the inner frame member 10 for taking in and out the ink cartridge 40 to and from the inner frame member 10. Although the ports 12 are formed on both the narrower side walls 11 in the illustrated embodiment, it may be possible to form one port 10 on one narrower side wall 11.

Ports 22 are also formed on narrower side walls 21 of the outer frame member 20 for taking in and out the ink cartridge 40 to and from the inner frame member 10 through the ports 22. Although the ports 22 are formed on both the narrower side walls 21 in the illustrated embodiment, it may be possible to form one port 22 on one narrower side wall 21.

The ink cartridge 40 can be taken out by pushing its one end and grasping its projected other end through the ports 12 and 22 and inserted by reversely performing the taking out operations. When the ports 12 and 22 are formed on one narrower side wall, the ink cartridge 40 can be taken out by pushing its side end using a user's finger or a stick inserted through the ports 121 and 221.

The self-inking stamp of the second embodiment can be assembled firstly by mounting the main body of stamp 50 in the inner frame member 10, then arranging the elastic member 30 on the top surface of the inner frame member 10, mounting the outer frame member 20 on the inner frame member 10, and finally inserting the ink cartridge 40 with aligning positions of the port 12 of the inner frame member 10 and the port 22 of the outer frame member 20.

A suitable lid may be mounted on the port 22. The lid is fitted on the outer frame member 20 and has a configuration so that it can entirely cover the port 22. The lid may be mounted on the outer frame member 20 via a hinge or a pivotal shaft or detachably mounted on the outer frame member 20. Provision of such a lid improves an appearance of the self-inking stamp since the lid can interrupt a view of inside of the stamp through the port 22.

Figure 9:
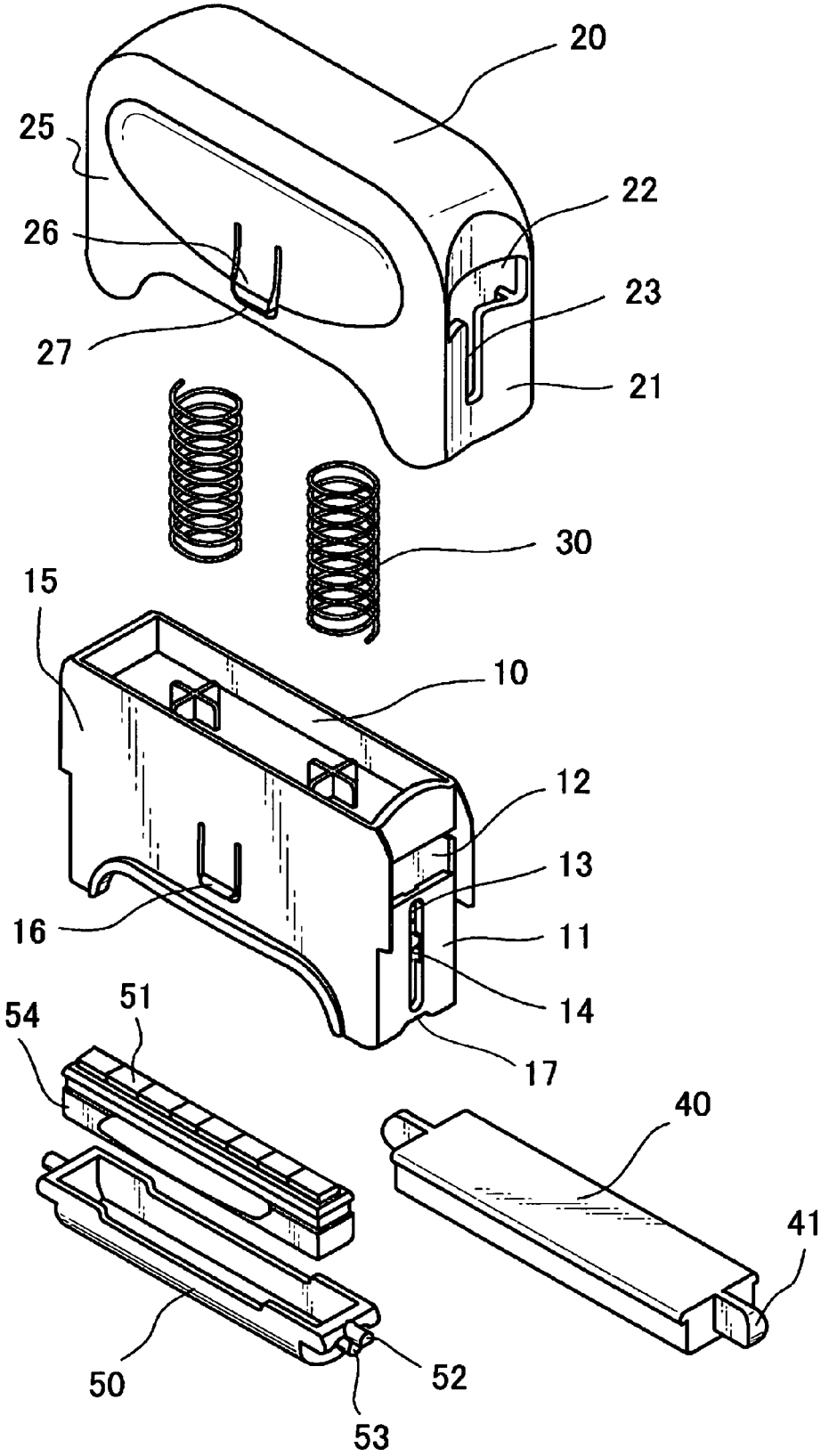
FIG. 9 An exploded perspective view taken from the top of a third embodiment of the self-inking stamp of the present invention.
Figure 10:
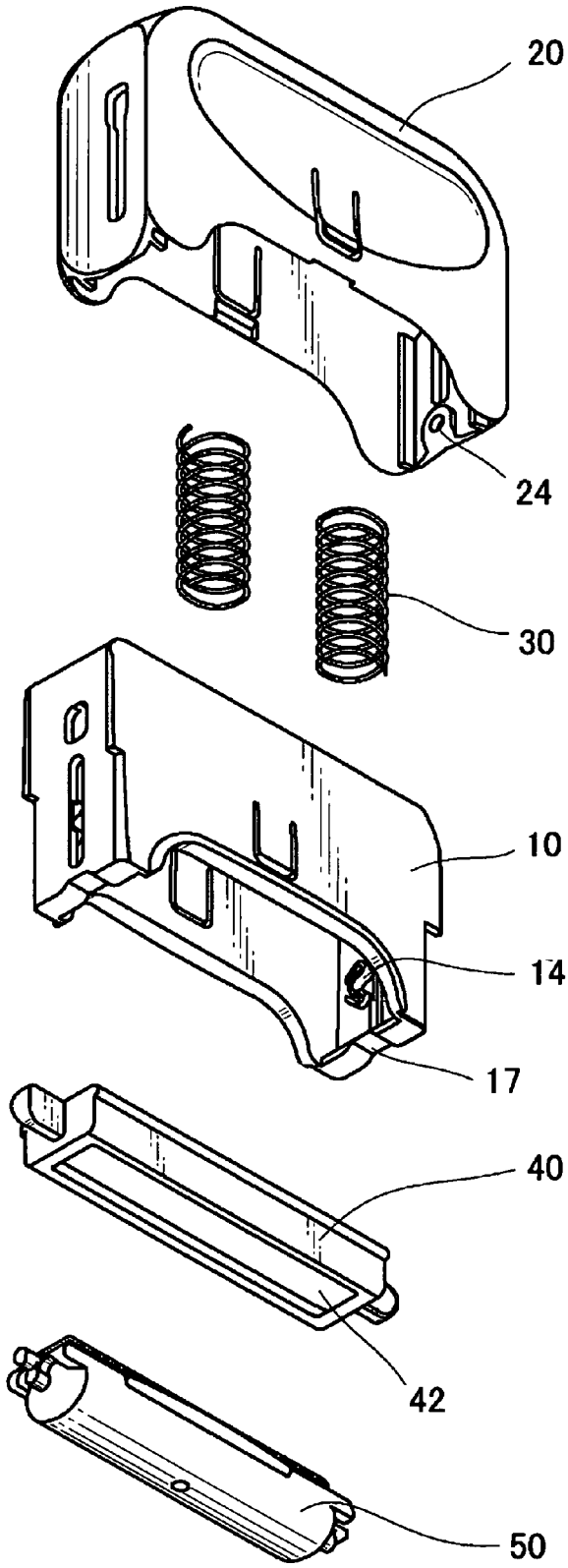
FIG. 10 An exploded perspective view taken from the bottom of a third embodiment of the self-inking stamp of the present invention.
Figure 11:
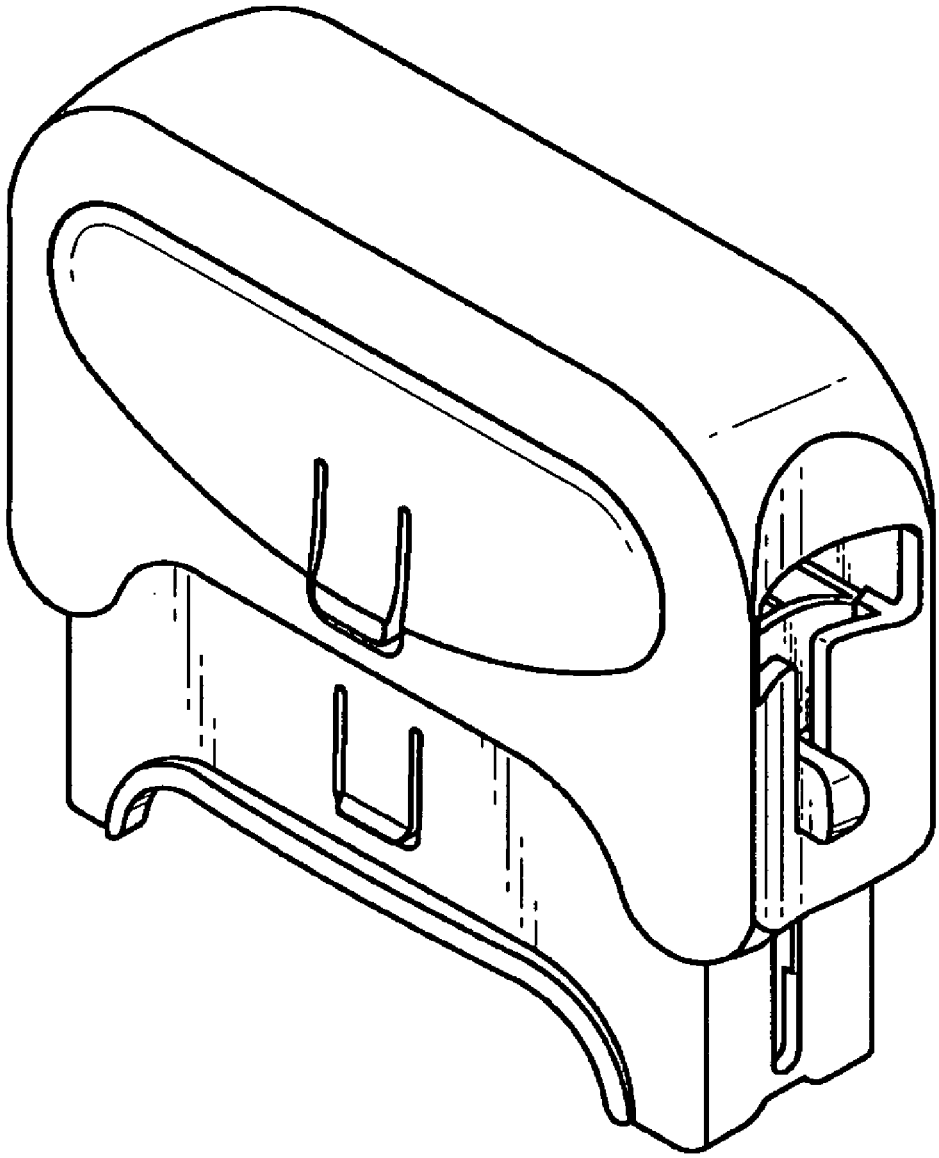
FIG. 11 A perspective view showing the whole of the self-inking stamp of the third embodiment of the present invention.

Then a third embodiment of the self-inking stamp of the present invention will be described with reference to FIGS. 9 through 11. Only features different from the first embodiment will be herein described.

Ports 22 are formed on narrower side walls 21 of the outer frame member 20 for taking in and out the ink cartridge 40 to and from the inner frame member 10 and grooves 23 continuously extend from the port 22 for enabling pinching portions 41 of the ink cartridge 40 can move therein. Thus downward motion of the outer frame member 20 is not interrupted. Although the ports 22 are formed on both the narrower side walls 21 in the illustrated embodiment, it may be possible to form one port 22 on one narrower side wall 21.

The ink cartridge 40 can be taken in and out through ports 12 of the inner frame member 10 and ports 22 of the outer frame member 20 with nipping the pinching portion 41. Although the pinching portions 41 are formed on both ends of the ink cartridge 40 in the illustrated embodiment, it may be possible to form only one pinching portion 41 on one end of the ink cartridge. In this case it is of course that the ports 12 and 22 and the groove 23 are formed on one narrower side wall.

The ink cartridge 40 can be assembled to the self-inking stamp by inserting the ink cartridge 40 to the inner frame member 10 through aligned ports 12 and 22 of the inner and outer frame members 10 and 20 with nipping the pinching portion 41.

The operation of the self-inking stamp of the third embodiment of the present invention will be described.

The ink cartridge 42 can be taken out from the stamp by pulling out the pinching portion 41 since the port 12 of the inner frame member 10 and the port 22 of the outer frame member 20 are secured at an aligned position of them. Similarly the insertion of the ink cartridge can be easily performed with nipping the pinching portion 41 of the ink cartridge 42. Since the pinching portion 41 is formed on the narrower ends of the ink cartridge 42 according to this embodiment, gripping of the outer frame member 20 is not interrupted by the presence of the pinching portion 41.

Figure 12:
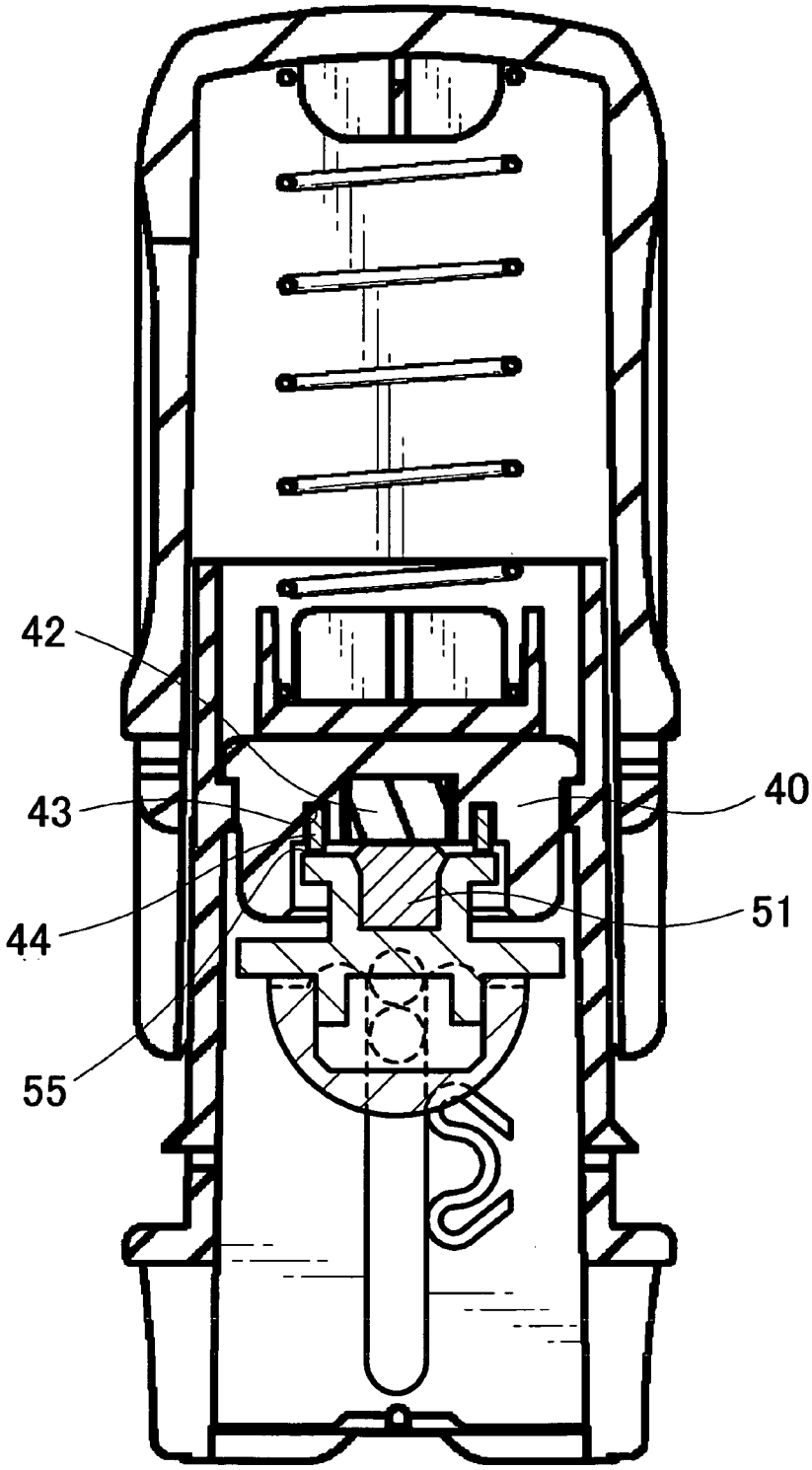
FIG. 12 A cross-section view of a fourth embodiment of the self-inking stamp of the present invention.

Then a fourth embodiment of the self-inking stamp of the present invention will be described with reference to FIG. 12. Only features different from the first embodiment will be herein described.

Either one of peripheral edges of a portion for holding the character arrangement block 51 or of a portion for containing the ink pad 42 is provided with a packing 44, and the other of the peripheral edges is provided with an abutting portion 55 against which the packing 44 abuts.

The "portion for containing the ink pad 42" means a portion of the ink cartridge 40 containing the ink pad 42 or a portion of the inner frame member 10 containing the ink pad 42.

In the structure in which the ink pad 42 is contained in the ink cartridge 40, a groove 43 is formed on a portion of the peripheral edge of the ink cartridge 40 containing the ink pad 42, and a packing 44 is arranged on the groove 43. The packing 44 is arranged around all the periphery of the ink pad 42. The packing 44 may be arranged in a groove formed in the groove 43. The packing 44 can be formed of various kinds of rubber material such as NBR (acrylonitrile-butadiene rubber), fluoroplastic, EPDM (ethylene-propylene-diene terpolymer), etc. Although it is not illustrated, the packing 44 is arranged on a peripheral edge of a portion of the inner frame member 10 containing the ink pad 42.

The "peripheral edge of a portion for holding the character arrangement block 51" means a peripheral edge of a portion of the main body of stamp 50 holding the character arrangement block 51 in a structure in which the character arrangement block 51 is directly held in the main body of stamp 50, and a peripheral edge of a portion of the character arrangement block holder 54 holding the character arrangement block 51 in a structure in which the character arrangement block holder 54 is held in the main body of stamp 50. In the structure in which the packing is arranged on the peripheral edge of the portion containing the ink pad 42, the abutting portion 55 is arranged on the peripheral edge of the portion holding the character arrangement block 51. The packing 44 is adapted to be closely abutted against the abutting portion 55 when the ink pad 42 is contacted by the character arrangement block 51 to sealingly close a region between the main body of stamp 50 and the ink cartridge 40.

In this description "closely abut" means that the packing 44 contacts with the abutting portion 55 without any gap therebetween.

Following modifications will be apparent to those skilled in the art.

Although the projection 16 is formed on the wider side wall 15 of the inner frame member 10 and the pusher 26 and the engaging portion 27 are formed on the wider side wall 25 of the outer frame member 20 in the illustrated embodiments of the self-inking stamp of the present invention, it is possible to adopt a different arrangement. That is, the projection 16 may be arranged on the narrower side wall 11 of the inner frame member 10 and the pusher 26 and the engaging portion 27 may be arranged on the narrower side wall 21 of the outer frame member 20.

Although the port 12 is arranged on the narrower side wall 11 of the inner frame member 10 and the port 22 is arranged on the narrower side wall 21 of the outer frame member 20 in the illustrated embodiments of the present invention, it is possible to arrange the port 12 on the wider side wall 15 of the inner frame member 10 and to arrange the port 22 on the wider side wall 25 of the outer frame member 20.

Although it is shown in the illustrated embodiment that the projection 16 and the pusher 26 are integrally formed respectively with the inner and outer frame members 10 and 20, they may be formed as separate parts from the inner and outer frame members such as buttons urged by springs.

The character arrangement block 51 may be an elongate character arrangement block comprising a plurality of integrally formed characters or numbers. The characters and numbers may be formed as individually separated ones adapted to be fitted in the holder 54 or may be formed by a thin material adapted to be directly stuck onto the main body of stamp 50, In addition although a rectangular self-inking stamp is described and illustrated, it will be apparent that the present invention may be applied to a circular self-inking stamp.

Furthermore a holding portion 17 for holding a member to be stamped may be formed on the bottom end of the inner frame member 10. The holding portion 17 functions to surely hold or grip any elongated circular or polygonal members to be stamped such as pencils etc. to perform exact stamping at a desired position.

The holding portion 17 may be a recess formed by a groove or by a plurality of projections.

The present invention has been described with reference to the preferred embodiments. Obviously, modifications and alternations will occur to those of ordinary skill in the art upon reading and understanding the preceding detailed description. It is intended that the present invention be construed as including all such alternations and modifications insofar as they come within the scope of the appended claims or the equivalents thereof.

EXPLANATION OF REFERENCE NUMERALS

10 . . . inner frame member
11 . . . narrower side wall
12 . . . port
121 . . . port
13 . . . slit
14 . . . reversing guide
15 . . . wider side wall
16 . . . projection
17 . . . holding portion
20 . . . outer frame member
21 . . . narrower side wall
22 . . . port
221 . . . port
23 . . . groove
24 . . . secured aperture
25 . . . wider side wall
26 . . . pusher
27 . . . engaging portion
30 . . . elastic member
40 . . . ink cartridge
41 . . . pinching portion
42 . . . ink pad
43 . . . groove
44 . . . packing
50 . . . main body of stamp
51 . . . character arrangement block
52 . . . central shaft
53 . . . reversing shaft
54 . . . character arrangement block holder
55 . . . abutting portion

What is claimed is:

1. A self-inking stamp comprising:

an inner frame member (10) provided therein with a reversing guide (14), an outer frame member (20) slidably mounted on the inner frame member (10) via an elastic member or members (30) therebetween, a main body (50) of a stamp containing a character arrangement block (51) and adapted to be reversed by the reversing guide (14), and an ink pad (42) adapted to be arranged within the inner frame member (10) characterized in:

that the inner frame member (10) is formed on its side wall with a projection (16) movable toward the inside of the inner frame member (10), that the outer frame member (20) is formed on its side wall with a pusher (26) for pushing the projection (16) toward the inside of the inner frame member (10) and an engaging portion (27) adapted to be engaged with the projection (16), and that a vertical relative motion between the inner and outer members (10, 20) is locked when the projection (16) is fitted in the engaging portion (27) and the lock is released when the pusher (26) is pushed inside to disengage the projection (16) from the engaging portion (27).

2. A self-inking stamp of claim 1 wherein the ink pad (42) can be contained within an ink cartridge (40), wherein a port (12) formed on one side wall of the inner frame member (10) for taking in and out the ink cartridge (40) to and from the inner frame member (10), and wherein a port (22) formed on one side wall of the outer frame member (20) for taking in and out the ink cartridge (40) to and from the inner frame member (10).

3. A self-inking stamp of claim 2 wherein the ink cartridge (40) is formed on its one side face with a pinching portion (41), and wherein the outer frame member (20) is formed with a groove (23) continuous with the port (22) in which the pinching portion (41) can slide therealong.

4. A self-inking stamp of claim 1 wherein each of the inner and outer frame members (10, 20) is a box of a rectangular parallelepiped of which a bottom is opened, and wherein the projection (16) is formed on a wider side wall (15) of the inner frame member (10), and the pusher (26) and the engaging portion (27) are formed on a wider side wall (25) of the outer frame member (20).

5. A self-inking stamp of claim 1 wherein the main body (50) of the stamp detachably contains a character arrangement block holder (54) for holding the character arrangement block (51).

6. A self-inking stamp of claim 1 wherein a holding portion (17) for holding a member to be stamped is formed on the bottom end of the inner frame member (10).

7. A self-inking stamp of claim 1 wherein either one of peripheral edges of a portion for holding the character arrangement block (51) or of a portion for containing the ink pad (42) is provided with a packing (44), and the other of the peripheral edges is provided with an abutting portion (55) against which the packing (44) abuts, and wherein the packing (44) is adapted to be closely abutted against the abutting portion (55) when the ink pad (42) is contacted by the character arrangement block (51).

* * * * *